United States Patent [19]

Uihlein et al.

[11] 4,407,084

[45] Oct. 4, 1983

[54] APPARATUS FOR STORING A PLURALITY OF SIGNS AND AUTOMATICALLY DISPLAYING SAID SIGNS AT PREDETERMINED TIMED INTERVALS

[75] Inventors: Robert E. Uihlein, Uniondale; Walter C. Severson, East Meadow, both of N.Y.

[73] Assignee: Signs by Severson Rent A Sign, Inc., Uniondale, N.Y.

[21] Appl. No.: 404,038

[22] Filed: Aug. 2, 1982

[51] Int. Cl.[3] ..... G09F 11/02

[52] U.S. Cl. ..... 40/475

[58] Field of Search ..... 40/475, 464, 111, 473, 40/447, 474, 467; 340/815.04

[56] References Cited

U.S. PATENT DOCUMENTS

| | | | |
|---|---|---|---|
| 1,049,356 | 1/1913 | Hegwer | 40/475 |
| 1,077,885 | 11/1913 | La Pearl | 40/475 |
| 1,831,962 | 11/1931 | Liss | 40/475 |
| 3,402,490 | 9/1968 | Goldman et al. | 40/475 |
| 3,696,358 | 10/1972 | Vasku | 40/467 |
| 3,965,592 | 6/1976 | Anos | 40/475 |
| 4,117,474 | 9/1978 | Augustine | 340/815.04 |

FOREIGN PATENT DOCUMENTS

| | | | |
|---|---|---|---|
| 381517 | 10/1964 | Switzerland | 40/475 |
| 737821 | 10/1955 | United Kingdom | 40/475 |

*Primary Examiner*—Gene Mancene
*Assistant Examiner*—Michael J. Foycik, Jr.
*Attorney, Agent, or Firm*—Michael I. Kroll

[57] ABSTRACT

Apparatus for storing a plurality of different signs and automatically displaying the different signs at timed intervals. A rectangular box-like housing is provided having a front window display area, a pair of bearings spaced apart and mounted within the housing, an elongated shaft rotatably mounted through the bearings, a pair of discs with each disc having a plurality of notches around its periphery and affixed to opposite ends of the elongated shaft, a plurality of panels, each panel having copy placed on each side and pivotally mounted off center at each end around the periphery of the discs so that the panels will turn and flip over when the disc rotates so they are displayed when they reach the front display area, a device for rotating the elongated shaft, and a switching device for starting and stopping the rotation of the elongated shaft at timed intervals whereby the two panels that are attached to the discs will be in a visable vertical position in the front window display area in the rectangular box-like housing for viewing.

3 Claims, 14 Drawing Figures

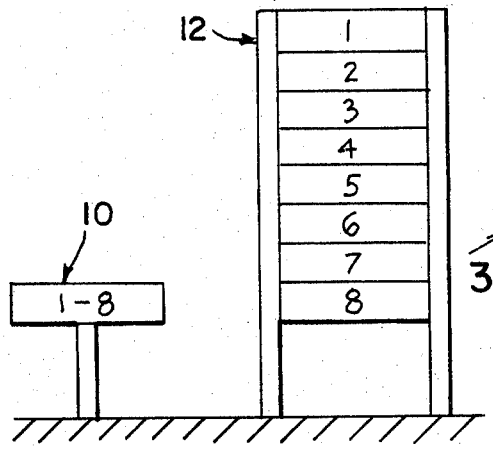
Figure 1
Figure 2A
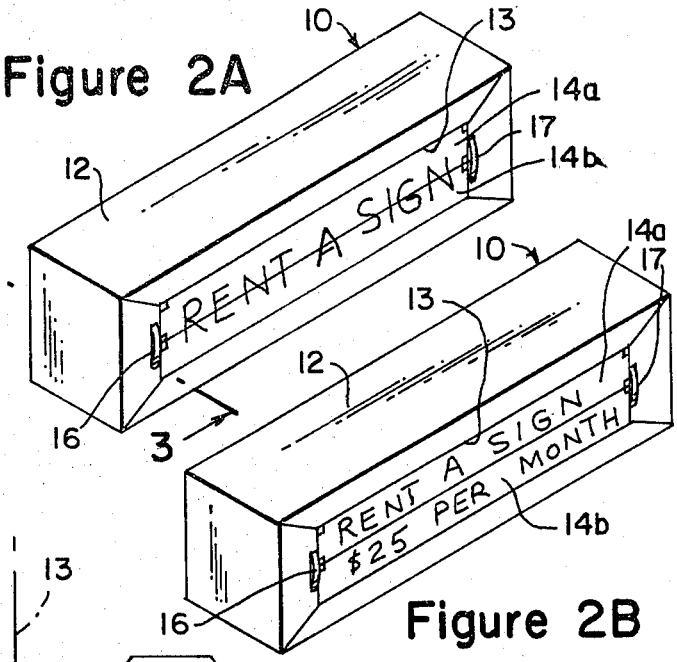
Figure 2B
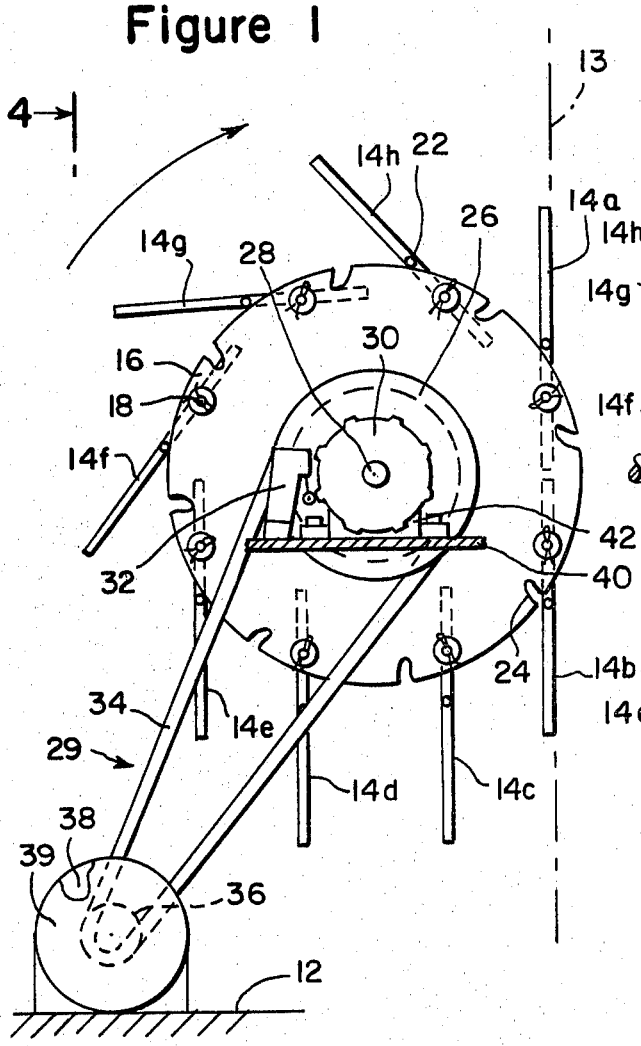
Figure 3
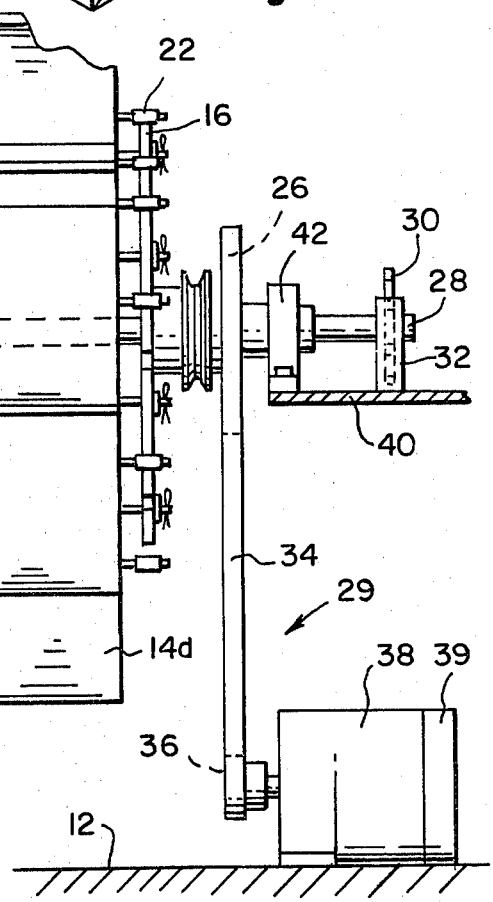
Figure 4

APPARATUS FOR STORING A PLURALITY OF SIGNS AND AUTOMATICALLY DISPLAYING SAID SIGNS AT PREDETERMINED TIMED INTERVALS

BACKGROUND OF THE INVENTION

1. Field of the Invention

The instant invention relates generally to display signs and more specifically it relates to an apparatus for storing a plurality of signs and automatically displaying said copy at timed intervals.

2. Description of the Prior Art

The prior art is exemplified by examples of devices used to display advertising for stores in shopping centers but are quite bulky and expensive. Many of the present day devices need large areas and block the view of the shoppers because the devices need to be high off the ground to contain all the signs required for all the stores in a shopping center. Additionally there are electronic signs that flash repetitive messages but these signs are expensive and do not offer very much versatility. The instant invention however offers a substantial improvement over the prior art as more fully described hereinafter.

SUMMARY OF THE INVENTION

In the present invention the disadvantages of the prior art are overcome by providing an apparatus for storing a plurality of signs and automatically displaying them at timed intervals.

The apparatus consists of a rectangular box-like housing having a front window display area, a plurality of panels, each panel having a sign placed on both sides and rotatably mounted within said housing whereby two panels will always be in a proper vertical position in the front window display area for viewing.

A principle object of the present invention is to provide an apparatus for storing a plurality of signs and automatically displaying them at timed intervals that utilizes a small area for displaying the signs. This is especially important when conforming to local zoning requirements contained in many local laws said zoning laws restricting the total sign area with relation to a specific piece of real property. The instant invention provides a means whereby individual fixed signs are combined into a single sign and accordingly the area for said signs are reduced by a factor of 8 to 16 or more. The instant invention may also eliminate the requirement of applying for zoning variences since said invention provides for 8 to 16 or more signs to be provided in the space allocated to a single sign.

Another object is to provide an apparatus for storing a plurality of signs and automatically displaying them at timed intervals that can have the predetermined time varied by adjustment.

An additional object is to provide an apparatus for storing a plurality of signs and automatically displaying said signs at timed intervals that can hold a variety of different replaceable signs.

A further object is to provide an apparatus for storing a plurality of signs and automatically displaying them at timed intervals that is economical in cost to manufacture.

A still further object is to provide an apparatus for storing a plurality of signs and automatically displaying them at time intervals that is easy to use in such a non offensive manner that said signs may be used in semi-residential areas without offending the surrounding community.

DESCRIPTION OF THE DRAWINGS

FIG. 1 is a front diagrammatic view of the invention next to the prior art.

FIG. 2A is a front perspective view of the invention displaying a single line sign.

FIG. 2B is a front perspective view of the invention displaying a double line sign.

FIG. 3 is a partial cross sectional view taken along line 3—3 in FIG. 2A.

FIG. 4 is a partial cross sectional view taken along line 4—4 in FIG. 3.

DESCRIPTION OF THE PREFERRED EMBODIMENTS

Figure 5:
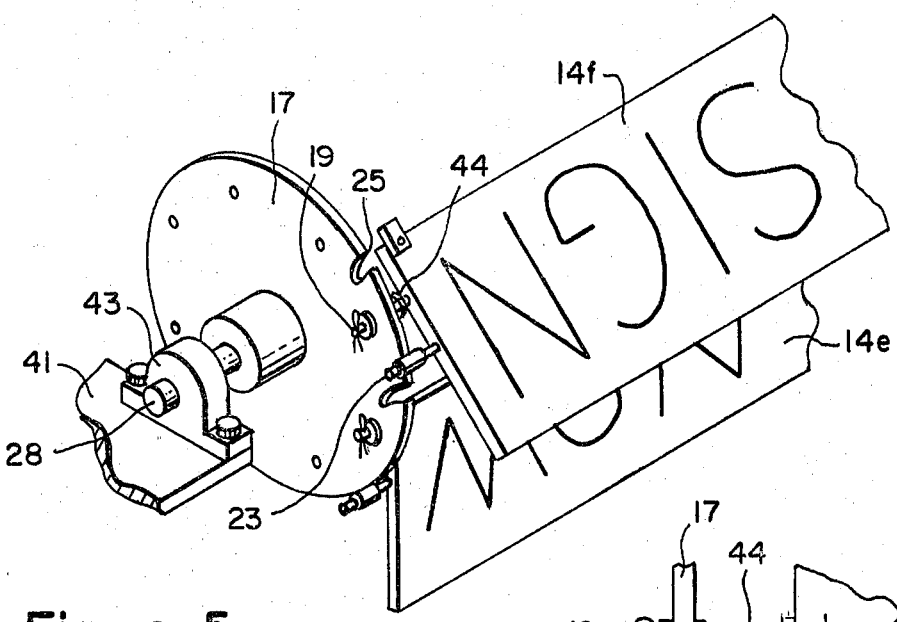
FIG. 5 is a partial rear perspective view of part of the invention with the housing removed.

Turning now descriptively to the drawings, in which similar reference characters denote similar elements throughout the several views, FIGS. 1 through 9 illustrates an apparatus 10 for storing a plurality of signs and automatically displaying them at timed intervals. FIG. 1 shows the apparatus 10 which is a new sign along side the prior art 12 which is an old sign. For example, the apparatus 10 can hold 1 through 8 different signs in a small area while the prior art 12 has said signs displayed all at one time which takes up eight times the space as apparatus 10.

FIGS. 2A and 2B shows that the apparatus 10 has a rectangular box-like housing 12 with a front window display area 13 and two panels 14*a* and 14*b* in a proper vertical position in the front window display area 13 for viewing. The lettering is split between the panel 14*a* and 14*b* in FIG. 2A and in FIG. 2B the lettering is on two lines one line of lettering on panel 14*a* and the other line of lettering on panel 14*b*.

FIGS. 2C, 3 4 and 5 show a pair of bearings 42 and 43, an elongated shaft 28, a pair of discs 16 and 17, a plurality of panels 14*a* through 14*h* and a means 29 for rotating the elongated shaft 28.

The bearings 42 and 43 are spaced apart and mounted within the housing 12. Bearing 42 is affixed to support plate 40 while bearing 43 is affixed to support plate 41. Elongated shaft 28 is rotatably mounted by means of bearings 42 and 43 with discs 16 and 17 affixed to opposite ends of the elongated shaft 28. Disc 16 has a plurality of notches 24 around its periphery while the disc 17 has a plurality of notches 25 around its periphery. Each panel 14*a* through 14*h* has copy placed on each side and is pivotally mounted off center at points 18 and 19 at each end around the periphery of said discs 16 and 17 so that the panels 14*a* through 14*h* will turn and flip-over in conjunction with the movement of discs 16 and 17.

Means 29 are provided for rotating the elongated shaft 28 and consists of a motor 38, a first pully 36, a second pully 26 and a V-belt 34. The motor 38 is mounted within the housing 12 and has the first pully 36 mounted on its shaft. The second pully 26 is mounted on the elongated shaft 28 while the V-belt 34 is mounted between the first pully 36 and the second pully 26 so that the motor 38 rotates the elongated shaft 28.

A plurality of stop pins 22 and 23 are also provided. The stop pin 22 is placed on one side of each panel 14*a* through 14*h* so that when the disc 16 turns and panels 14*a* thru 14*h* rotate the stop pin 22 will partially engage into notch 24 in the disc 16. The stop pin 23 is placed on the other side of each panel 14*a* through 14*h* so that when the disc 17 turns the top pin 23 will partially engage into notch 25 in the disc 17 so that when each panel 14*a* through 14*h* flips over the stop pins 22 and 23 will move partially into notches 24 and 25 respectively to prevent each panel 14*a* through 14*h* from coming to an abrupt stop.

Figure 6:
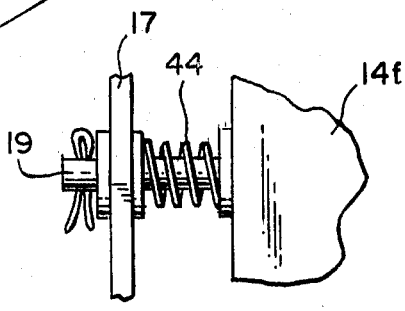
FIG. 6 is a detail view of the pivot area shown in FIG. 5.

As best shown in FIG. 6 a drag spring 44 is attached at one pivotally mounted end 19 between the disc 17 and the side of the panel 14*f*. Each panel 14*a* through 14*h* has a drag spring so that when each panel 14*a* through 14*h* flips over as the disc 16 turns, the drag spring 44 will have a damping effect on the panel 14*a* through 14*h*.

Figures 7A, 7B, 7C, 7D:
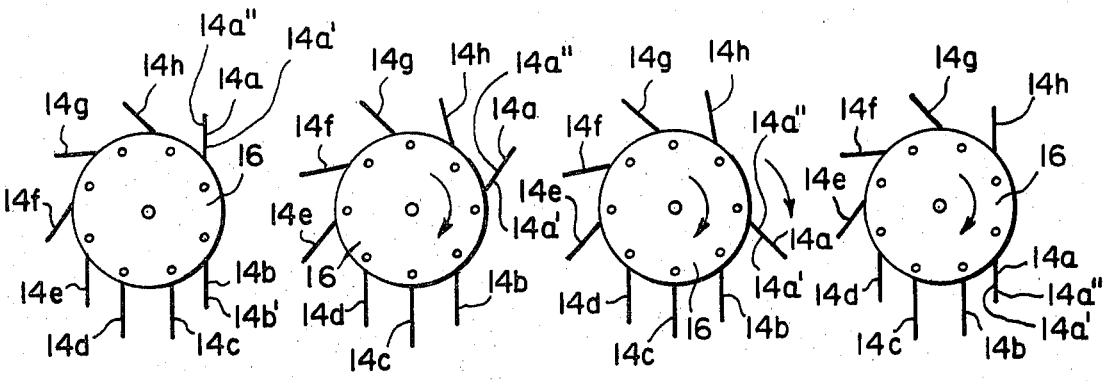
FIGS. 7A through 7D show a diagrammatic side view of the disc and panels in various steps of rotation.

FIGS. 7A through 7D shows the typical movement whereby disc 16 completes one cycle. In FIG. 7A panel 14*a* has a visable sign side 14*a'* and a hidden sign side 14*a''*. As shown, panel 14*a* is vertical and directly above the vertical panel 14*b*. In FIGS. 7B and 7C the disc 16 turns whereby the panel 14*a* pivots at points 18 and 19 and flips over. In FIG. 7D the panel 14*h* is vertical and above the vertical panel 14*a* so that sign side 14*a''* is now visible and no longer hidden. This cycle repeats itself and thus provides the desired changes in sign copy.

Figure 8:
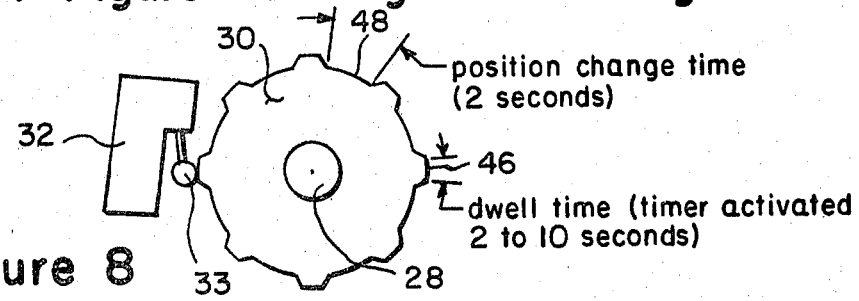
FIG. 8 is a detail end view of the cam and microswitch.
Figure 2C:
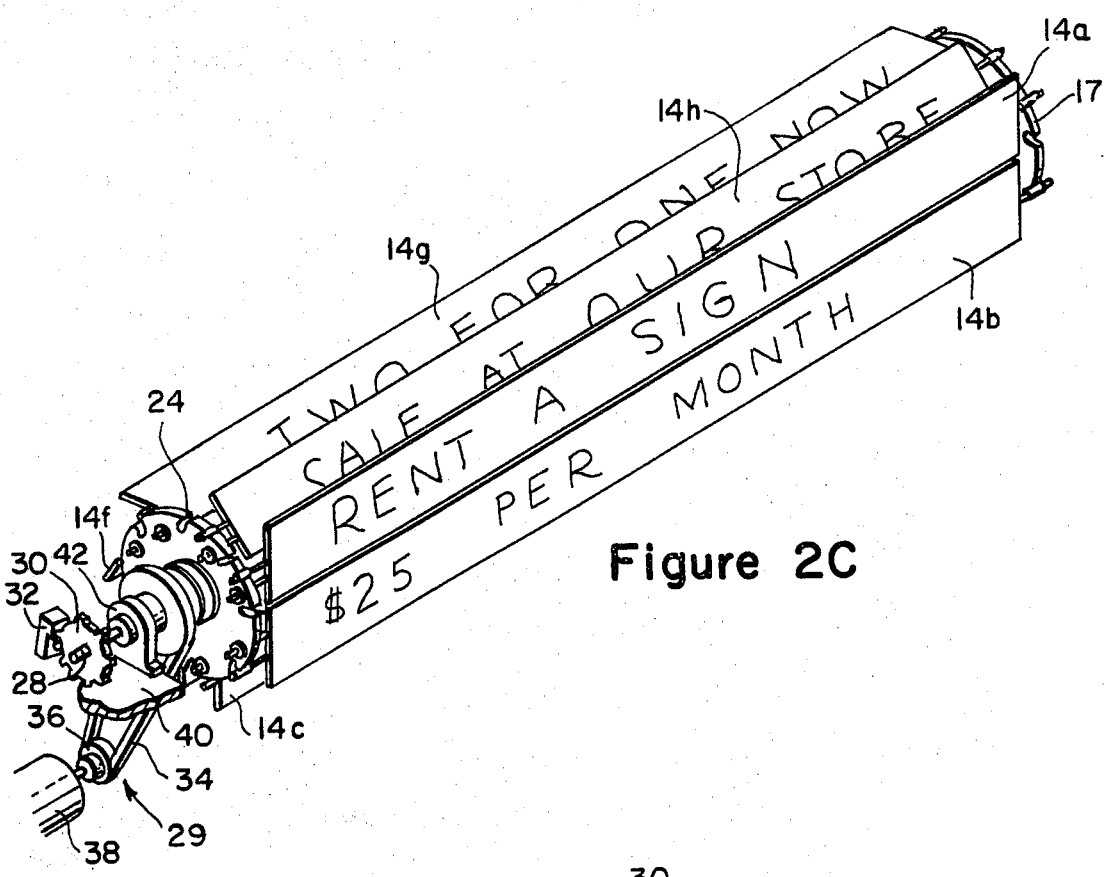
FIG. 2C is a front perspective view like FIG. 2B with the housing and some parts removed.
Figure 9:
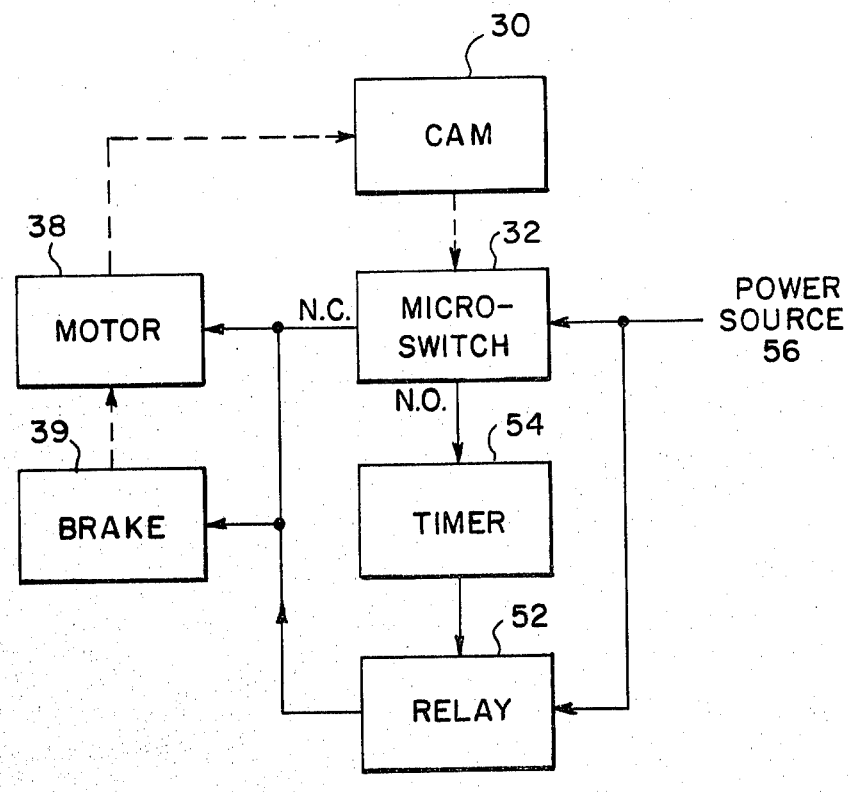
FIG. 9 is a block diagram of the means for starting and stopping the rotation of the elongated shaft.

FIGS. 8 and 9 show the means for starting and stopping the rotation of the elongated shaft 28 at timed intervals and consists of a brake 39, a cam 30, a microswitch 32, a relay 52 and a timer 54.

Said brake 39 is connected to the motor (see FIG. 4). The cam 30 has a plurality of high points 46 which is the dwell time and a plurality of low points 48 which represents the time to change said copy on said signs around its periphery in the same number as the panels 14*a* through 14*h* and cam 30 is mounted and fixed to one end of said elongated shaft 28.

The microswitch 32 is provided with roller contact 33 that engages said cam 30 and said microswitch 32 is mounted within the housing 12 and is electrically connected between a power source 56 and the motor 38 with the brake 39 so that when a low point 48 on the cam 30 engages the roller 33 the microswitch will be in a normally closed position allowing voltage to go directly to the motor 38 which rotates cam 30 and at the same time disengage the brake 39. The relay 52 is mounted within the housing 12 and electrically connected between the power source 56 and the motor 38 with the brake 39.

Said timer 54 is mounted within the housing 12 and is electrically connected between the microswitch 32 and the relay 52. When a high point 46 on the cam 30 engages roller 33 microswitch 32 will be in a normally open position and disconnects the voltage to the motor 38 and activates timer 54 and brake 38 and said brake stops the rotation of motor 38 and cam 30 so that all panels remain in a fixed position as in FIG. 7A and copy on panel 14*a* (side 14*a'*) and copy on panel 14*b* (side 14*b'*) are visable during the dwell time in FIG. 8.

Said timer 54 is set for a dwell time of typically 2 to 10 seconds and when said time elapses the timer activates motor 38 and disengages brake 39 so that cam 30 rotates so that the next set of panels take the place of the former set of panels and a new message is displayed at which time microswitch 32 again via switch 32 and high point 46 on cam 30 stops the power to motor 38, engages brake 39 and starts timer 54 with said cycle repeating itself for as long as power is supplied to said system.

The motor 38 can typically be a 20 RPM motor and the brake 39*a* sterns brake model number 1-001-011 although other types of motors 38 and brakes 39 may be used if applicable.

Panels 14*a* thru 14*h* may be fabricated of any suitable material although a light weight construction is preferred so that the continued movement of said panels do not cause excessive wear. Said panels may be constructed from a single piece of material or may be fabricated into composite built-up structure.

While the form of apparatus herein described constitutes a preferred embodiment of the invention, it is understood that the invention is not limited to this precise form of apparatus and that changes may be made therein without departing from the scope of this invention.

Said invention may be illuminated so that said copy is visiable at night and said illumination means may be connected to a photoelectric device that will automatically activate the illumination means during periods of darkness.

Having regard to the foregoing disclosure the following is claimed as the inventive and patentable embodiments thereof:

1. Apparatus for storing a plurality of signs and automatically displaying them at timed intervals which comprises:

(a) a rectangular box-like housing having a front window display area;

(b) an elongated shaft rotatably mounted through the bearings;

(c) a plurality of panels, each panel having a copy placed on each side, pivotally mounted off center at each end, around the periphery of the discs so that the panels will turn with the discs so they can be displayed when they reach the front display area;

(d) means for rotating the elongated shaft comprising:
  (1) a motor mounted within the housing;
  (2) a first pully mounted on shaft of motor;
  (3) a second pully mounted on the elongated shaft;
  (4) a V-belt rotatably mounted between the first pully and the second pully so that the motor rotates the elongated shaft; and (e) means for starting and stopping the rotation of the elongated shaft at timed intervals whereby two panels on the discs will be in a proper vertical position in the front window display area in the rectangular box-like housing for viewing comprising:
  (1) a brake connected to the motor;
  (2) a cam having a plurality of high points and a plurality of low points around its periphery in the same number as the panels, the cam mounted to one end of the elongated shaft;

(3) a microswitch having a roller that engages the cam, the microswitch mounted within the housing and electrically connected between a power source and the motor with the brake, so that when a low point on the cam engages the roller the microswitch will be in a normally closed position allowing the voltage to go directly to the motor to turn the cam and at the same time disengage the brake;

(4) a relay mounted within the housing and electrically connected between the power source and the motor with the brake; and (5) a timer mounted within the housing and electrically connected between the microswitch and the relay, so that when a high point on the cam engages the roller the microswitch will be in a normally open position disconnecting the voltage to the motor and sending an electrical impulse into the timer whereby when predetermined time is reached the timer will send the impulse into the relay causing the relay to activate, supplying voltage to the motor until low point on the cam is reached again which will disconnect both the timer and the relay allowing the voltage again to go directly to the motor via the microswitch to turn the cam and at the same time disengage the brake until the next timing cycle begins again.

2. Apparatus for storing a plurality of signs and automatically displaying them at timed intervals as recited in claim 1 that further comprises:

(a) a plurality of stop pins, each stop pin placed on each side of each panel so that when the discs turn, each stop pin will partially engage a notch on each disc as each panel falls over to prevent each panel from bouncing up; and (b) a plurality of drag springs, each drag spring attached at one pivotally mounted end between the disc and the side of each panel so that when each panel falls over when the disc turns, the drag spring will have a damping effect on the panel.

3. Apparatus for storing a plurality of signs and automatically displaying them at timed intervals as recited in claim 2 that further comprises:

(a) a pair of bearings spaced apart and mounted within the housing; and (b) a pair of discs, each disc having a plurality of notches around its periphery and affixed to opposite ends of the elongated shaft.

* * * * *